United States Patent [19]

Mullich et al.

[11] Patent Number: 4,564,229

[45] Date of Patent: Jan. 14, 1986

[54] LATCH ASSEMBLY HAVING SELECTABLE BACKSET DISTANCE

[75] Inventors: Richard O. Mullich, Burbank; Anthony J. Rotondi, Whittier, both of Calif.

[73] Assignee: TRE Corporation, Los Angeles, Calif.

[21] Appl. No.: 485,180

[22] Filed: Apr. 18, 1983

[51] Int. Cl.[4] ..... E05C 1/12; E05B 9/02

[52] U.S. Cl. ..... 292/169.13; 292/337

[58] Field of Search ..... 292/169, 1, 169.13, 292/169.21–169.23, 337, DIG. 44, DIG. 60; 70/129, 134, 143, 461, 447–449, 451

[56] References Cited

U.S. PATENT DOCUMENTS 2,299,181 10/1942 Schlage ..... 292/337
2,390,756 12/1945 Voight ..... 292/169.13
2,676,051 4/1954 Hillgren ..... 292/169.22 X
2,732,239 1/1956 Wilson ..... 292/169.22
4,427,224 1/1984 Bergen ..... 292/1 X

*Primary Examiner*—Kenneth J. Dorner
*Assistant Examiner*—Russell W. Illich
*Attorney, Agent, or Firm*—Spensley Horn Jubas & Lubitz

[57] ABSTRACT

A latch mechanism is provided in which one of two different backset distances is facilitated in a single latch assembly. A latch slide which is used to retract the latch bolt of the assembly is provided with a removable latch slide extension which determines the distance from the face plate of the assembly to the center of the actuating assembly. The latch slide and bolt are carried within a latch case or housing which includes slots formed therein. The actuating assembly includes jaws which fit into the slots in order to fix the position of the latch assembly with respect to the actuating assembly upon final installation of the mechanism into the door.

6 Claims, 5 Drawing Figures

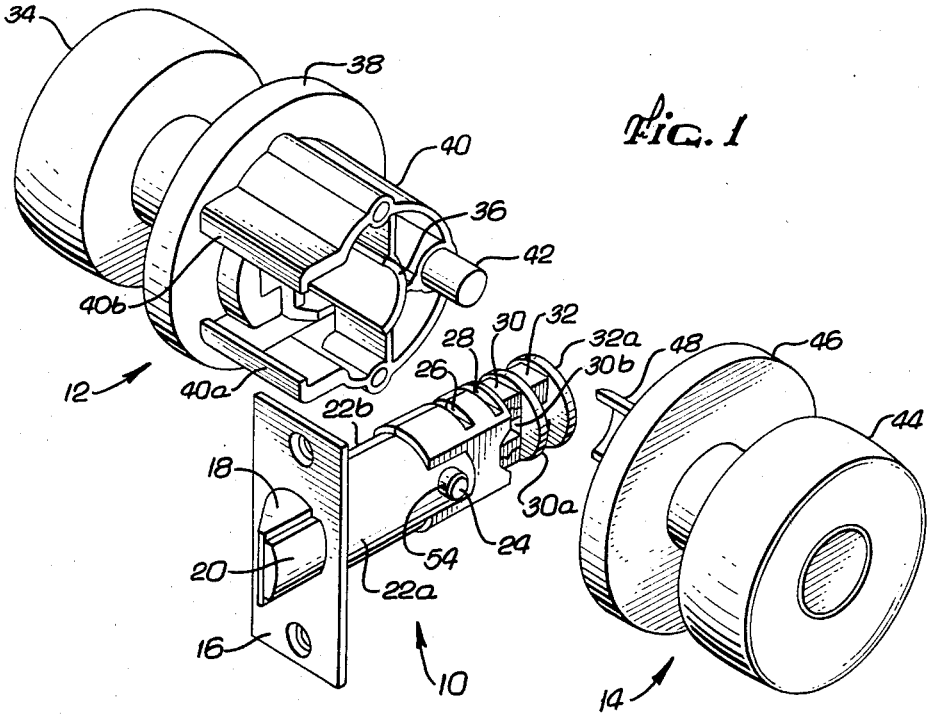
Fig. 1
Fig. 3
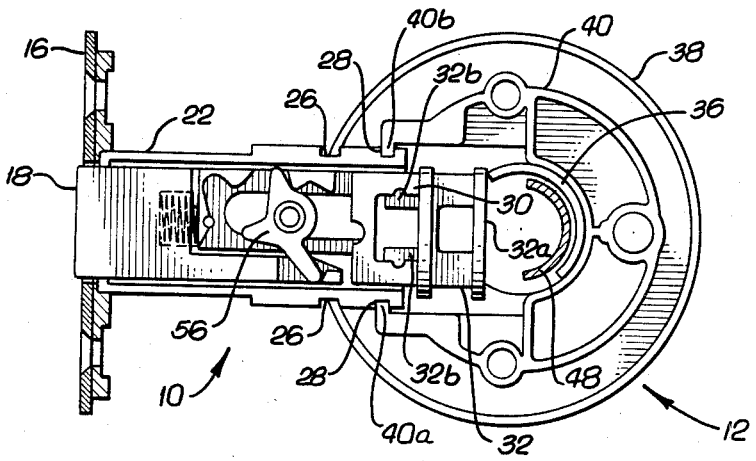

LATCH ASSEMBLY HAVING SELECTABLE BACKSET DISTANCE

BACKGROUND OF THE INVENTION

1. Field of the Invention

This invention relates to spring latch-type assemblies. More particularly, this invention relates to a spring latch-type lockset in which one of two different backset distances may be selected when assembling the lockset in a door.

Latch mechanisms typically are provided with one of two different backsets, i.e., the distance from the edge of the door to the center of the knob. The most common backset distances are $2\frac{3}{8}''$ and $2\frac{3}{4}''$. In a new door, the customer must prepare the door by drilling for specific backset dimensions. In the replacement market, doors are already drilled and the customer must match the predrilled door with the proper backset latch mechanism.

2. Description of the Prior Art

In the prior art, one of two completely separate latch mechanisms was provided depending upon the desired backset. Several problems arise due to the use of separate latch mechanisms. In the new construction market, the wrong backset may be specified by the customer or packing and shipping errors may occur, with the result in either case being that the customer will receive the wrong latch for his project. In the retail market, there are a large number of products returned when the customer discovers that an error was made in the selection of a latch mechanism for his application, resulting in a variety of losses after the seal of the package has been broken. Furthermore, the provision of two different latch mechanisms creates problems of inventory maintenance.

SUMMARY OF THE INVENTION

The present invention is directed to a lockset in which one or two different backset distances can be selected when assembling the lockset in a door. The lockset includes the actuating assembly and the latch mechanism. The latch mechanism includes a latch case with faceplate which slideably carries a latch bolt and a latch slide. The latch slide is coupled to the latch bolt via a cam so that movement of the latch slide toward the face plate will cause the latch bolt to be retracted. The latch slide includes a substantially planar end face which is contacted by spindles of an actuating assembly. Rotation of either of the spindles causes the latch slide to move within the latch case and thereby retract the latch bolt.

The latch slide has a length which will provide the shorter of two desired backsets, e.g. $2\frac{3}{8}''$. The latch slide is constructed so that it can receive a separate element called a latch slide extension which is snapped into the back of the latch slide. The latch slide extension increases the effective length of the latch slide by $\frac{3}{8}''$, and in so doing, will convert the $2\frac{3}{8}''$ backset latch mechanism into a $2\frac{3}{4}''$ backset latch mechanism.

The latch case and cover which carries the latch bolt and latch slide includes two pairs of slots which are used to position the actuating assembly with respect to the latch mechanism. The actuating assembly includes a housing having a pair of parallel jaws which engage into the slots on the latch case and cover and secure the actuating knob assembly with respect to the latch mechanism. The jaws will be positioned in one of the two pairs of slots dependent upon the desired backset.

BRIEF DESCRIPTION OF THE DRAWINGS

The invention will now be described with reference to the appended drawings wherein:

FIG. 1 is an exploded perspective view of the invention;

FIGS. 2–4 are sectional views showing the latch mechanism and the lock housing of the invention.

DESCRIPTION OF THE PREFERRED EMBODIMENT

Figure 4:
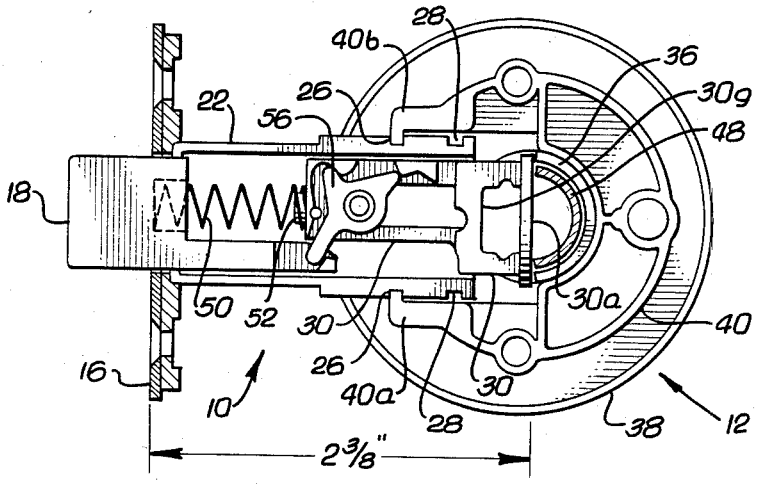

The following description is of the best presently contemplated mode of carrying out the invention. This description is made for the purpose of illustrating the general principles of the invention and is not to be taken in a limiting sense. The scope of the invention is best determined by reference to the appended claims.

Referring to FIG. 1, a lockset according to the present invention includes a latch mechanism indicated generally at 10 and first and second actuating assemblies indicated at 12 and 14. The latch mechanism includes a face plate 16 from which a latch bolt 18 and a dead latch bolt 20 extend. The latch bolt 18 extends from one end of a latch case 22 which is formed two pieces 22*a* and 22*b*. In the preferred embodiment the two sections are riveted together at 24. The latch case includes two pair of slots 26 and 28 located at two positions along its length. (The lower slots of each pair are not visible in FIG. 1.)

Extending from the rear of the latch case is a latch slide 30 having a substantially planar rear face 30*a*. The latch slide includes a square central opening 30*b*. A latch extension 32 having a substantially planar rear face 32*a* is attached to the latch slide 30 by means of legs 32*b* (FIG. 5) which extend into the opening 30*b*.

The first actuating assembly includes a knob 34 from which extends a semi-cylindrical spindle 36. A face plate 38 is secured to a lock housing 40 which carries a push button locking assembly 42. The lock housing 40 has a substantially cylindrical configuration and includes a pair of jaws 40*a* and 40*b* which extend outward from the cylinder. The push button assembly does not form part of the present invention and will not be described in any detail (the actuating assembly does not need to have a locking assembly to function).

The second actuating assembly 14 includes a knob 44, a face plate 46 and a semi-cylindrical spindle 48. The push button assembly 42 of the lock housing 40 extends through an opening in the face plate 46 (not shown), and the push button assembly is actuated by the pressing of its button.

Figure 2:
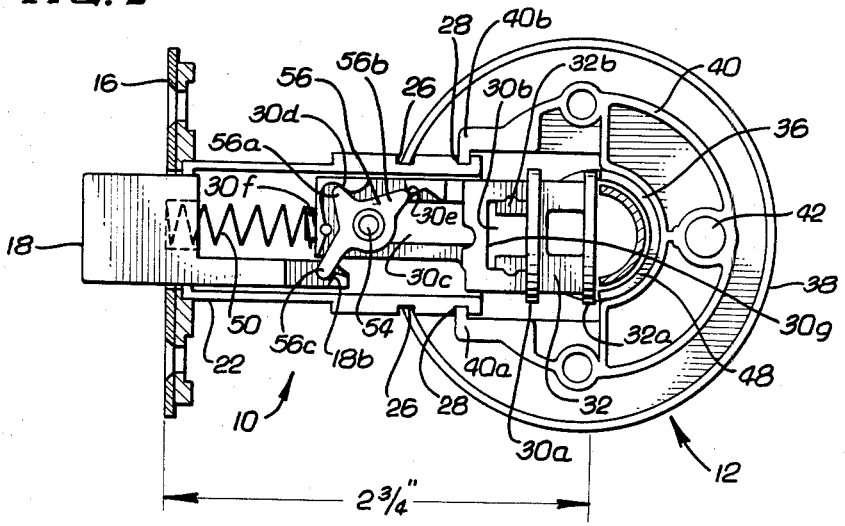

Referring now to FIGS. 2 and 3, the operation of the latch assembly will be described. For purposes of clarity, the actuator assembly for the dead latch bolt 20 has been omitted from the drawings. The dead latch actuator assembly does not need to be included in the latch mechanism for the latch to function. The dead latch actuator assembly does not form a part of the invention and is of a conventional design. The latch bolt 18 is slideable within the latch case 22 and is biased into an extended position by means of a spring 50 which presses against a post 30*f* integral with the slide 30. The latch bolt 18 is generally "L" shaped, as is the latch slide 30. The latch slide 30 is also slideable within the latch case 22 and includes a central opening 30*c* through which a post 54 integral with the latch case 22 extends. The sections 22*a* and 22*b* of the latch case 22 are secured together at the post 54, i.e., the post 54 extends through an opening in the section 22*a* and is riveted. A cam 56 is pivotal about the post 54. The cam 56 includes first and second lobes 56*a* and 56*b* which abut shoulders 30*d* and 30*e* of the latch slide 30, respectively. The cam also includes a third lobe 56*c* which abuts a shoulder 18*b* of the latch bolt 18.

Referring now to FIGS. 2 and 3, if one of the actuating assemblies 12 or 14 is turned, its associated spindle 36 or 48 will rotate and press against the rear face 32*a* of the latch slide extension. This causes the latch slide to move toward the faceplate 16. The shoulders 30*d* and 30*e* will therefore press against the lobes 56*a* and 56*b* of the cam and cause the cam to pivot about the post 54. The rotation of the cam 56 causes the lobe 56*c* to press against the shoulder 18*b* of the latch bolt 18 and thereby retract the latch bolt 18. Retraction of latch bolt is shown in FIG. 3, while extension of the latch bolt is shown in FIGS. 2 and 4. The jaws 40*a* and 40*b* of the lock housing 40 are positioned in the slots 28 located toward the rear of the latch case 22. In FIG. 2, the backset distance, i.e., the distance from the center of the actuating assemblies 12 and 14 to the face plate 16, corresponds to the larger of the two desired backset distances (typically $2\frac{3}{4}''$). The jaws 40*a* and 40*b* serve to fix the position of the actuating assemblies 12 and 14 with respect to the latch mechanism.

When it is desired to provide the shorter backset distance (e.g. $2\frac{3}{8}''$) the latch slide extension 32 is removed and the actuating assembly 12 is positioned so that the jaws 40*a* and 40*b* are positioned in the slots 26, which are positioned closer to the face plate 16 than are the slots 28. This configuration is illustrated in FIG. 4. Thus, by the simple removal of the latch slide extension 32, and the repositioning of the jaws 40*a* and 40*b* from the slots 28 to the slots 26, the backset distance may be changed from $2\frac{3}{4}''$ to $2\frac{3}{8}''$. Thus, the provision of two different backsets in a single assembly is facilitated by providing the removable latch slide extension 32 and two pairs of slots 26 and 28 in the latch mechanism 10.

Figure 5:
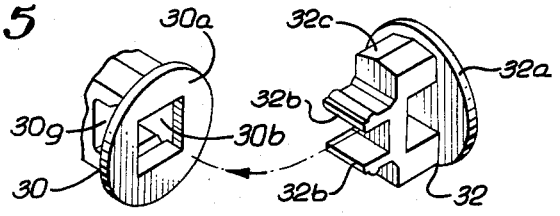
FIG. 5 is a perspective view of the latch slide and latch slide extension of the invention.

When the shorter $2\frac{3}{8}''$ backset is desired, removal of the latch slide extension 32 is a simple procedure. As illustrated in FIG. 5, the extender has a body portion 32*c* which has a substantially "U" shaped configuration. The latch slide extension in the present embodiment is formed of a zinc die casting and the legs 32*b* are very slightly deflected when inserted into the opening 30*b* of the latch slide 30. The latch slide extension 32 is maintained attached to the latch slide 30 by means of a friction fit between the legs 32*b* and the latch slide 30. When the shorter backset is desired, a screwdriver or other tool is inserted in between the legs 32*b* of the latch slide extension 32 and the surface 30*g* of the slide extension 30 to pry the latch slide extension 32 from the latch slide 30 by means of a lever action. The latch mechanism 10 and activating assembly 12 are then assembled in a door in a configuration shown in FIG. 4 (i.e., with a $2\frac{3}{8}''$ backset).

Thus, the present invention provides a single assembly which can be constructed with one of two (or more) different backset distances. The assembly is quite simple, and selection of the different backset distances is facilitated by the simple removal of the slide extension and repositioning of the actuating assemblies with respect to the latch mechanism. It should be appreciated that various modifications will occur to those skilled in the art without departing from the scope of the invention.

We claim:

1. A latch mechanism having a selectable backset distance, comprising:

a hollow latch case assembly;

a face plate attached to the latch case assembly;

a latch bolt slidably carried within the latch case assembly and movable between an extended and retracted position;

a latch slide slidably carried within the latch case assembly and extending from the end of the latch case assembly opposite the latch bolt, one end of the latch slide having a pressing face for receiving a pushing force in the direction of latch bolt extension;

a coupling mechanism coupling the latch bolt to the latch slide so that movement of the latch slide will retract the latch bolt;

a one piece removable latch slide extension having two ends, one end attached to said one end of the latch slide, the other end of the extension having a pressing face for receiving a pushing force in the direction of said latch bolt extended position; and an actuator assembly including a spindle extending along an axis perpendicular to the direction of travel of the latch slide and an actuator housing, the spindle having a face for pressing against the other end of the latch slide extension thereby to apply said pushing force, the latch case assembly and the actuator housing including engaging means for mutually engaging said latch case assembly and said housing at two alternative locations, wherein in a first configuration the actuator housing is connected at the first location to the latch case assembly so that the spindle is positioned adjacent the latch slide extension and in a second configuration the latch slide extension is removed and the actuator housing is connected at the second location to the latch case assembly so that the spindle is positioned adjacent the end of the latch slide, said configurations defining first and second backset distances from the face plate to the spindle of the actuator assembly, wherein rotation of the spindle causes said spindle face to push against the pressing face of the latch slide extension thereby to cause retraction of the latch bolt.

2. A latch mechanism according to claim 1 wherein the actuator assembly includes a housing, and wherein the engaging means includes means, associated with said housing for securing the actuator assembly in one of at least two fixed positions with respect to the latch case.

3. A latch mechanism according to claim 2 wherein the latch case assembly includes at least two pairs of slots formed therein at different positions along the length of the latch case assembly and wherein the means for securing includes a pair of jaws which extend into at least one of the pairs of slots depending upon the desired backset distance.

4. A latch mechanism according to claim 1 wherein the spindle of the actuator assembly has a semicylindrical configuration.

5. A latch mechanism having a selectable backset distance, comprising:

a hollow latch case assembly;

a face plate attached to the latch case assembly;

a latch bolt slidably carried within the latch case assembly and moveable between an extended and retracted position;

a latch slide slidably carried within the latch case assembly and extending from the end of the latch case assembly opposite the latch bolt, the end of the latch slide extending from the latch case assembly having a substantially planar face which has an opening;

a coupling mechanism coupling the latch bolt to the latch slide so that the movement of the latch slide will retract the latch bolt;

a removeable latch slide extension attached to the end of the latch slide, the latch slide extension being comprised of a body having a planar face portion, the body including a pair of legs extending therefrom which are adapted for insertion into the opening in the latch slide, the latch slide extension being maintained attached to the latch slide by means of a friction fit; and an actuator assembly including a spindle extending along an axis perpendicular to the direction of travel of the latch slide, wherein in a first configuration the spindle is positioned adjacent the latch slide extension and in a second configuration the latch slide extension is removed and the spindle is positioned adjacent the end of the latch slide, said configurations defining first and second backset distances from the face plate to the spindle of the actuator assembly, wherein rotation of the spindle causes retraction of the latch bolt.

6. A latch mechanism according to claim 1 wherein the latch slide and the latch slide extension are configured for cooperative press fit engagement.

* * * * *